US008066276B2

(12) United States Patent
Fenile

(10) Patent No.: US 8,066,276 B2
(45) Date of Patent: Nov. 29, 2011

(54) DEVICE FOR SEPARATING INDIVIDUAL FLAT, BENDABLE OBJECTS FROM THE UNDERSIDE OF A STACK OF SUCH OBJECTS AND FOR TRANSPORTING THE SEPARATED OBJECTS AWAY

(75) Inventor: Roberto Fenile, Wetzikon (CH)

(73) Assignee: Ferag AG, Hinwil (CH)

( * ) Notice: Subject to any disclaimer, the term of this patent is extended or adjusted under 35 U.S.C. 154(b) by 248 days.

(21) Appl. No.: 12/471,780

(22) Filed: May 26, 2009

(65) Prior Publication Data

US 2009/0289409 A1 Nov. 26, 2009

(30) Foreign Application Priority Data

May 26, 2008 (CH) ..... 0787/08

(51) Int. Cl.
*B65H 3/64* (2006.01)

(52) U.S. Cl. ..... 271/132; 271/99; 271/100; 271/131

(58) Field of Classification Search ..... 271/3.05, 271/23, 99–101, 35, 131–144
See application file for complete search history.

(56) References Cited

U.S. PATENT DOCUMENTS 4,127,262 A * 11/1978 Eberle et al. ..... 271/12
4,555,101 A * 11/1985 Stobb ..... 271/12
6,332,607 B1 * 12/2001 Van Der Werff ..... 271/101
6,666,447 B2 12/2003 Keller
6,702,276 B2 3/2004 Muller
2002/0041067 A1 * 4/2002 Muller ..... 271/99

FOREIGN PATENT DOCUMENTS

EP 1226083AO 5/2001
EP 1254855 A2 11/2002
WO 2007/051324 5/2007
WO 2008/000099 1/2008

* cited by examiner

*Primary Examiner* — Jeremy R Severson
(74) *Attorney, Agent, or Firm* — Rankin, Hill & Clark LLP

(57) ABSTRACT

A device for separating of individual, flat objects from the underside of a stack of this kind of objects (2) includes a roll bed conveyor consisting of a plurality of circulating rollers (9) and supporting the stack from beneath, wherein the rollers (9) are respectively rotatable around their longitudinal axis (10) and are moved along an orbit (11). Hereby the rollers (9) are coupled by a coupling (8) to at least one roller wheel (7) and, by means of this coupling, the longitudinal axes (10) of the rollers (9) are respectively pivotable in relation to the roller wheel (7). The rollers (9) are pivoted in a releasing region (13) of the orbit (11), through which an opening of the roll bed conveyor is created. Thus, the flat objects (2) can individually be conveyed from beneath the stack and transported away through the opening.

13 Claims, 3 Drawing Sheets

Fig.4
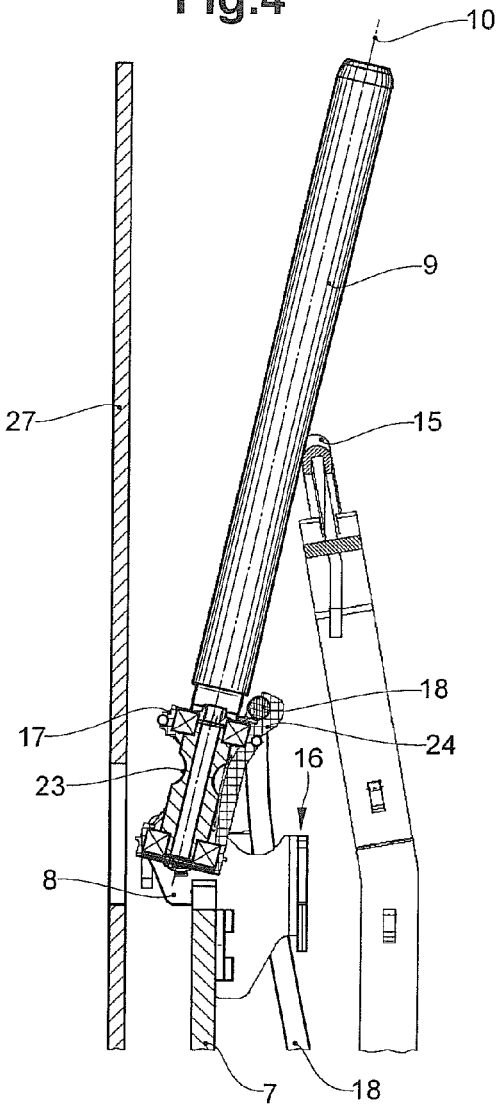
Fig.5
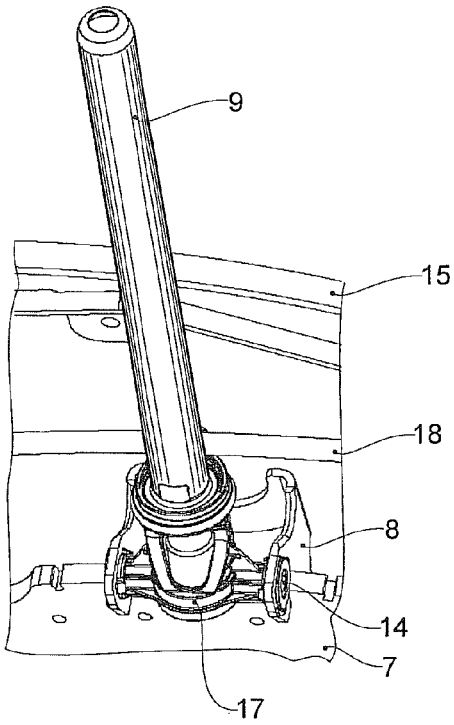
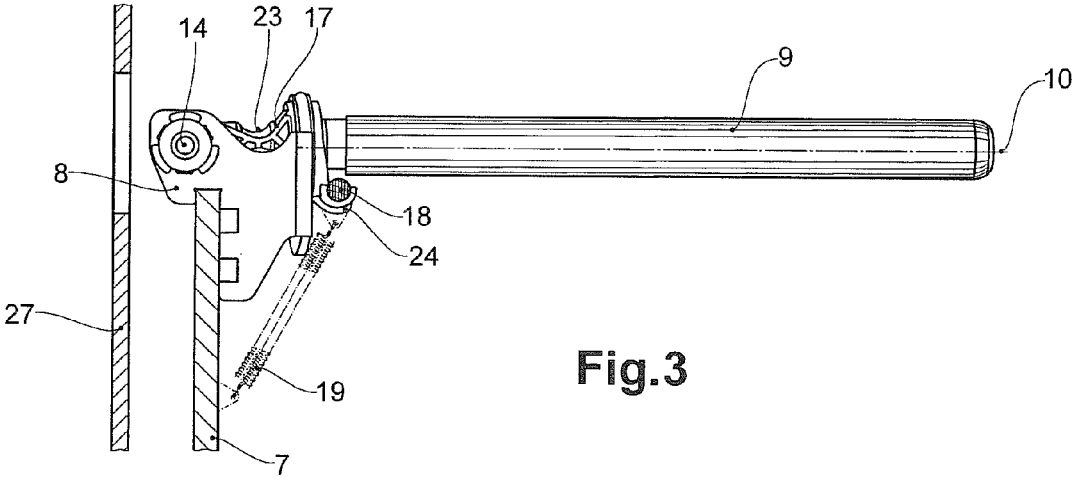
Fig.3

DEVICE FOR SEPARATING INDIVIDUAL FLAT, BENDABLE OBJECTS FROM THE UNDERSIDE OF A STACK OF SUCH OBJECTS AND FOR TRANSPORTING THE SEPARATED OBJECTS AWAY

BACKGROUND OF THE INVENTION

1. Field of the Invention

The invention is the field of conveying flat, bendable objects, in particular of printed products, and concerns a device according to the generic term of the independent claim. The device serves for the separation of individual flat, bendable objects from the underside of a stack of such objects and for the onward transportation of the objects, in particular for the separation of individual printed products from the underside of a stack of printed products and for onward transportation of the printed products.

2. Description of Related Art

From publication EP1226083, a device is known which serves the purpose named above. For separation of individual printed products from the underside of the stack of printed products, the device comprises a carrier wheel, arranged below the stack, rotating on a substantially horizontal axis, on the periphery of which pairs each consisting of a suction device and a gripper allocated to the suction device are arranged. The device further comprises a supporting means, which on the one hand supports the stack from below, on the other hand comprises at least one extraction opening, through which the lowermost printed product may be gripped and for separation may be bent away from the stack towards the gripper allocated to the suction device. The carrier wheel is arranged and driven such that the suction device and gripper are moved in parallel to a pair of edges of the stacked printed products and approximately centrally between these edges below the stack. The suction devices are rotated in a controlled manner during the rotation of the carrier wheel and connected to a suction pipe and de-coupled from it. The grippers are closed and re-opened in a controlled manner during the rotation. When a suction device is moved through underneath the stack, it grips the lowermost printed product in the region of the edge orientated transversally to its direction of movement it meets first, and when moving further it bends this edge region downwards through the extraction opening in the supporting means into the open allocated gripper, which then grips the printed product and removes it completely from the stack during its further movement.

In an embodiment described in publication EP1226083, the supporting means on which the stack rests is a roll bed conveyor, which comprises a plurality of rollers arranged horizontally and in parallel to each other and are mounted to be freely rotatable, and which are aligned to the suction devices and grippers but are moved through below the stack on a substantially rectilinear and horizontal path. Hereby, the movements of the rollers and the suction devices are adjusted in relation to one another such that the suction device may grip the lowermost printed product of the stack in-between two successive rollers and may draw out its edge region, and the upstream roller of the two may move in-between the printed product gripped by the suction device and the printed product resting thereupon. The roll bed conveyor thus forms a succession of extraction openings orientated in parallel to the rollers and to the printed product edges gripped by the suction devices, which openings successively move through beneath the stack. In order for the stack to be securely supported and for the extraction openings to be large enough all the same, it is suggested to move the rollers through beneath the stack in groups of three, wherein the rollers within the groups of three are at smaller distances from each other and wherein between succeeding groups a larger interspace is provided and only this interspace is used as an extraction opening. The rollers forming the roll bed conveyor underneath the stack consist of two mutually aligned roller sections, which are at a distance from each other. Thus, it is prevented that the suction devices conflict with the rollers. A circulating chain is provided on each side of the carrier wheel, one for the left roller sections and one for the right roller sections, wherein the roller sections are coupled to these chains and revolve with the chain at constant distances to each other. The orbit of the chains on both sides runs around a deflection roller arranged coaxially to the carrier wheel and around a further deflection roller with a parallel axis, which is arranged such that an upper part of the orbits is approximately horizontal between the deflection rollers. The stack is arranged above this region of the orbit of the rollers.

The device according to EP1226083, thus, comprises a revolving roll bed conveyor with extraction openings, wherein the stack is arranged on the outside of this roll bed conveyor. When separated from the stack of printed products, the printed products are drawn through an extraction opening to the inner side of the circulating roll bed conveyor, from where they need to reach its outer side for being conveyed further. For this purpose the roller sections in the corresponding region are rotated into a substantially vertical position in their orbit. In this region the printed products are laid down on a conveying belt and released by the grippers, wherein the conveying belt follows the circular movement of the grippers in a substantially tangential manner.

The device described in publication EP1226083 works without problems and without requiring much space. It is, however, a costly device, and is restricted regarding the direction of onward transportation.

In publication WO 2008/0000099, a device is described which serves the same purpose. Again, a roll bed conveyor is on hand, wherein the rollers of the roll bed conveyor are fitted to a roller wheel, which e.g. circulates on the same axis as the carrier wheel. The drawn out printed products are, however, not drawn completely into the inner region of the roll bed conveyor, but only partly. In this position, the printed products are conveyed in synchrony with the roll bed conveyor over a certain distance and then deposited on a transport track. Thus it is not—as in EP1226083—necessary to open the roll bed conveyor in a certain region in order to transport the printed products outwards from the inside of the roll bed conveyor. Therefore, the orientation of the rotation axis of the rollers remains unchanged and the rollers circulate on a non-circular orbit, on which the distances between the rollers are varied. For this purpose the rollers are flexibly linked to the roller wheel by means of levers, such that the levers are rotatable in parallel to the rotation plane of the roller wheel. A definite orbit and a definite and consistent course of movement of the rollers along this orbit are defined by a roller guidance, which controls the movement of the rollers along the orbit.

Publication EP1254855 also shows a roll bed conveyor, in which the rollers are fitted to a roller wheel. In order to open the roll bed conveyor in a certain region, the rollers are tilted away on a tilting axis, which is substantially radial or secantial respectively in relation to the roller wheel. For rotating the rollers, a cam control is provided. A wheel rolling on a cam moves the rollers via a lever mechanism with several levers. Because of unfavourable leverage due to the relatively long rollers and the tilting point of the rollers being near the lever mechanism the forces developed on the lever mechanism, are considerable and conversely the resulting movement of the rollers is not defined to complete precision.

BRIEF SUMMARY OF THE INVENTION

The invention thus has the object to create a device for the same purpose as the devices described above, which is, however, more simple in design and effects a flowing, precise movement of the rollers.

This object is achieved by a device with the characteristics according to claim 1.

The device for separation of individual flat, bendable objects from the underside of a stack of such objects and for the onward transportation of the objects thus includes:

a stacking space with a supporting arrangement supporting the stack from beneath, circulating separation and transportation devices for separating the objects from the underside of the stack and an arrangement for onward transportation of the separated objects.

Hereby the supporting arrangement is a roll bed conveyor formed by a plurality of circulating rollers, wherein the rollers are respectively rotatable around their longitudinal axis and are moved along an orbit and thereby are moved through below the stack in a supporting region in a manner aligned to the separation and transportation devices.

The rollers are respectively coupled by means of a coupling to at least one roller wheel and by means of this coupling the longitudinal axes of the rollers each can be pivoted in relation to the roller wheel. The rollers are pivoted in a release region of the orbit by a controlling element and, thus, produce an opening of the roll bed conveyor, through which opening the arrangement for onward transportation is routed.

The separation and transportation devices, thus, draw the objects through the (not opened) supporting region into an inner region of the roll bed conveyor. The roll bed conveyor is opened for outward conveying of the objects in a release region, in which the objects again leave the inner region.

Due to the rollers being arranged on a roller wheel—and not on a belt or on a chain—a very simple design of the roll bed conveyor is possible.

The rotation of the rollers and, thus, the opening of the roll bed conveyor in the release region are preferably implemented by means of a preferably fixed control curve or cam, e.g. in that the rollers roll on the control cam. Hereby, advantage is taken from the fact that the rollers are preferably mounted in a roller carrier in a manner rotatable around their longitudinal axis. Thus, a rigid control cam may easily be used without further movable control elements. The control cam is advantageously arranged on the inside of the orbit and presses the rollers or the roll bed conveyor, respectively, open from the inside. Alternatively, the rollers may be extended backwards beyond the roller carriers such that the rear ends of the rollers are pressed towards each other by a control runner or cam, which is arranged outside the roll bed conveyor, and thus the front ends of the rollers are moved away from each other. Other mechanical, pneumatic, hydraulic or electrical operation means may also be used for the pivoting of the rollers.

The roller carriers are advantageously mounted on the roller wheel to be pivotable around a rotation axis. In the supporting region the longitudinal axes of the rollers preferably run substantially in perpendicular to the plane or the rotation plane of the respective roller wheel. This perpendicular position is preferably defined by a mechanical stop, which limits the rotation movement in a corresponding stopping position. Basically, it is also possible to incline the roller wheels and to form the stop such that the rollers run, in the region of the stack, where they serve as support, in parallel to the underside of the stack (in general horizontally).

By means of the control runner or cam, on the one hand, and the stop on the other hand a simple movement control device consisting of few parts with favourable leverage and therefore a precise guidance of the roller movement is created.

A preferred embodiment of the invention includes a pre-tensing device, which respectively draws the roller carriers, and thus their rollers, in the direction of the stopping position of the pivoting movement. In a particularly simple, preferred embodiment, the pre-tensing device comprises an elastic pulling cable, which connects roller carriers of the individual rollers of a roller wheel to each other and thus draws all these roller carriers and with them their rollers into the direction of the stopping position of the rotation movement. In a different preferred embodiment the pre-tensing device comprises a set of spring elements, wherein an individual spring element is allocated to each roller, which effects a load between roller and roller wheel, wherein this load draws the roller into the direction of the stop.

In a preferred embodiment of the invention, the rollers are freely rotatable and are, at least in a section of the orbit, preferably at least in the supporting region, rotatable by rolling on a rolling-off body, wherein this rotation corresponds to a rolling movement of the rollers on the bottommost object of the stack. Thus, the rotation of the rollers is effected by the rolling-off body and not by the bottommost object, which prevents damage of this object.

The rolling-off body is preferably a cable tensed around a sector of the orbit from the outside. It may also be a fixed rail or runner against which the rollers are guided.

The device according to the invention preferably includes two opposing roller wheels with facing, preferably mutually symmetric sets of rollers. The axes of the two roller wheels are advantageously coaxial, can, however, also e.g. be inclined towards the inside of the device. For certain applications, however, one single roller wheel may be adequate.

In a preferred embodiment of the invention the at least one roller wheel and the carrier wheel of the suction devices and grippers comprise parallel rotation axes, which makes a simple design possible. Furthermore, preferably the carrier wheel and the at least one roller wheel are driven at identical angular speeds, preferably by the same drive and coupled through a gearbox.

Further preferred embodiments emanate from the dependant claims.

BRIEF DESCRIPTION OF THE DRAWINGS

In the following, the object of the invention is explained in more detail on the basis of preferred embodiment examples, which are shown diagrammatically in the attached drawings. Hereby:

FIG. 3 shows a front view of a roller in a position perpendicular to the plane of the roller wheel;

FIG. 4 shows a front view of a roller in a pivoted position; and

FIG. 5 shows a perspective view of a roller in a pivoted position.

DETAILED DESCRIPTION OF THE INVENTION

Figure 1:
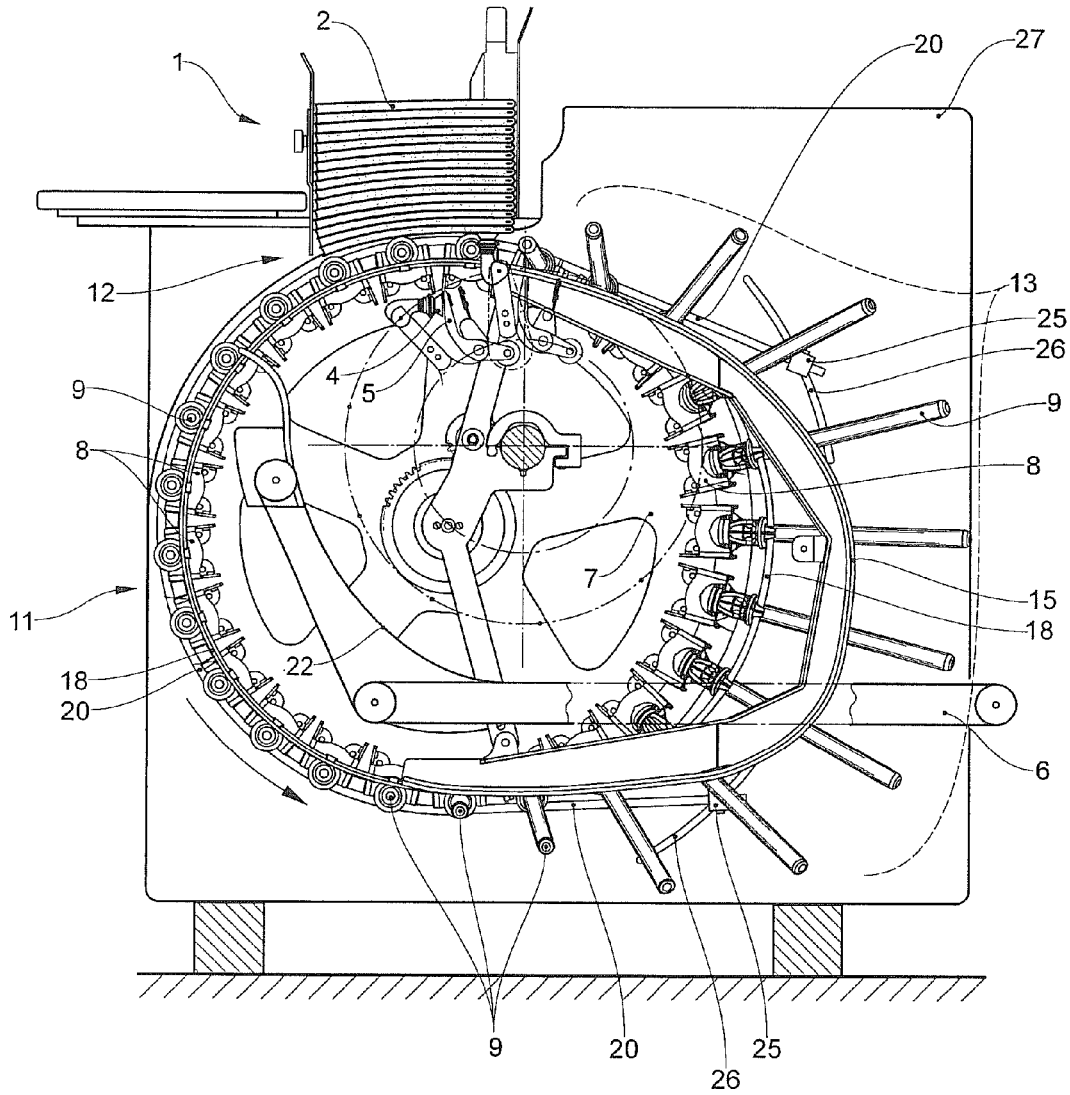
FIG. 1 shows a side view of a device according to the invention with an angle of view onto a plane of roller wheels.

The reference numerals in the drawings and their denotations are summarized in the reference numeral list. In the figures identical parts are basically denotated with identical reference numerals.

Figure 2:
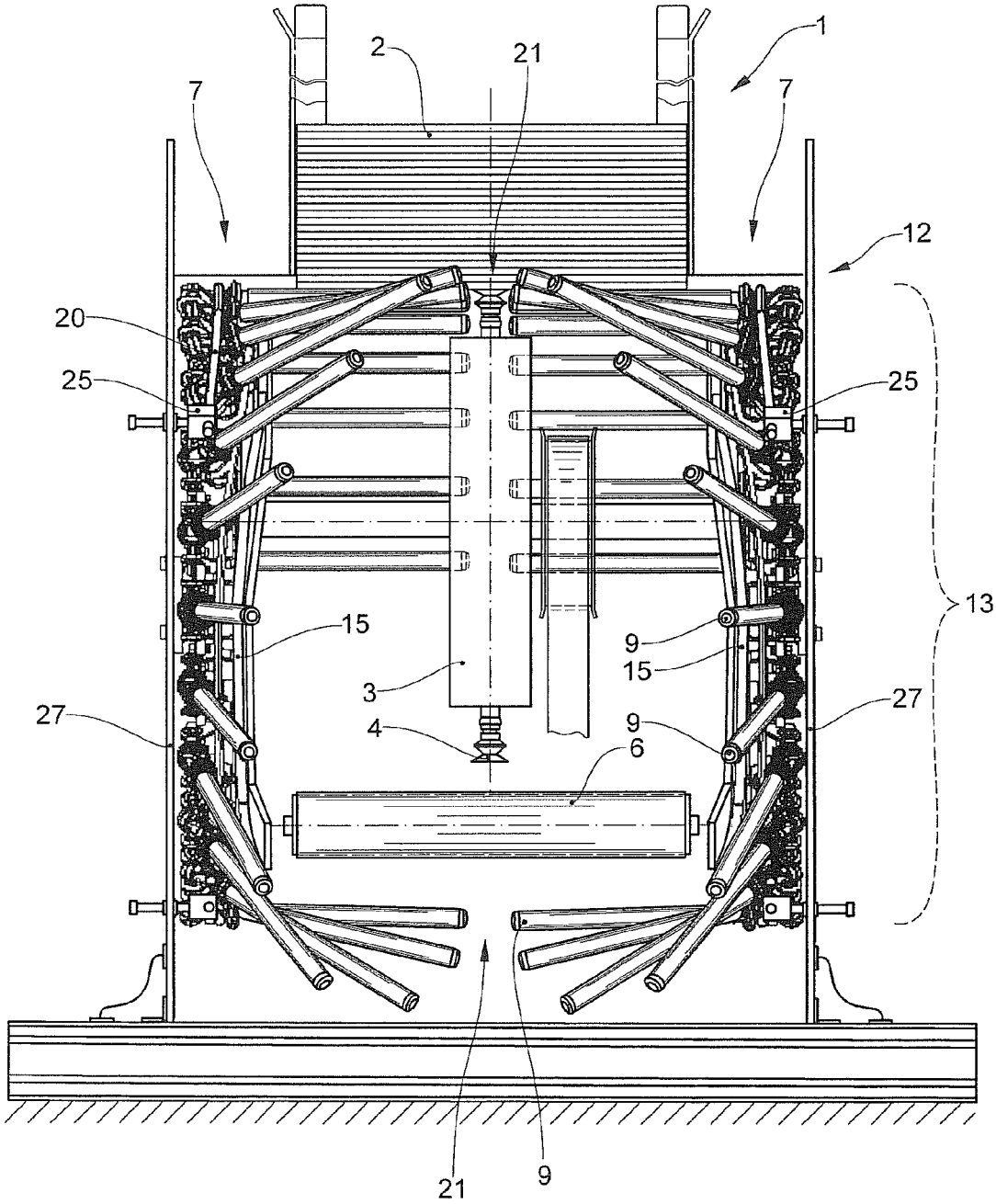
FIG. 2 shows a front view of this device, viewed along the plane of the roller wheels.

FIG. 1 shows a side view of the device according to the invention, in a view onto a roller wheel 7 and FIG. 2 shows a corresponding front view viewed along the plane of the roller wheels 7. On one of the respective roller wheels 7, a plurality of rollers 9 is pivotably fitted by means of respective couplings 8. The totality of the rollers 9 forms a roll bed conveyor circulating along an orbit 11. In a first region of the orbit 11, the longitudinal axis of the rollers 9 runs perpendicular to the plane of the roller wheel 7, thus also perpendicular to the plane of the drawing. This first region comprises at least one supporting region 12, in which flat objects 2, stacked in a stacking space 12, lie upon the rollers 9. In the first region, the rollers roll on a rolling-off body 20. In the shown embodiment the rolling-off body 20 is a cable tensed around part of the orbit. The cable 20 is e.g. held and tensible by means of holding bodies 25, which are adjustably arranged in grooves of a casing wall 27.

In a second region of the orbit 11, referred to as release region 13 in the following, the rollers 9 are pivoted by a control runner or cam 15 out of the normal direction to the plane of the drawing. A tensioning or pulling means, here a tensioning cable or pulling cable 18, draws the rollers back against a stop in this direction.

The following elements concern the transport of the flat objects through the device. Elements arranged and acting in analogy are described in more detail in the publications EP1226083, EP1254855 and WO 2008/0000099, which are summarized further above. Thus, FIG. 1 shows only two of a plurality of suckers or suction devices 4 with associated grippers 5 as release and transport means. FIG. 2 additionally diagrammatically shows a carrier wheel 3 on which the suction devices 4 and grippers 5 are arranged. A plurality of such (not shown) suction devices 4 and grippers 5 circulates in an anticlockwise direction on a course shown in broken lines in FIG. 1. In an interspace 21 between the two roller wheels 7 or their rollers 9, respectively, the suction devices 4 may be led towards the flat objects 2. Hereby in each case a suction device 4 releases one of the flat objects 2 or printed products, and a gripper 5 grips this printed product 2 and draws it through in-between the rollers 9 into the inside of the orbit 11. Subsequently, the gripper 5 draws the printed product 2 along a supporting belt or a supporting rail 22 onto a means 6 for outward conveyance, e.g. a conveying belt, and releases it. The means 6 for outward conveyance conveys the printed product 2 through the roll bed conveyor out of orbit 11.

FIG. 3 shows a frontal view of a roller 9 in a position in perpendicular to the plane of the roller wheel 7. FIG. 4 shows a frontal view and FIG. 5 a view in perspective of a roller 9 in a pivoted position. Apart from the previously described elements, the figures show the couplings 8, which are fixedly connected to the roller wheel 7. In a coupling 8, a roller carrier 17 is respectively mounted to be pivotable around a pivot axis 14. The pivot axis 14 is preferably substantially tangential in relation to the rotation direction of the roller wheel 7. A roller 9 is mounted in roller carrier 17 to be rotated around the roller's longitudinal axis 10. The rollers 9 are, thus, mounted on one end, are rod shaped and extend lengthwise over a large part of the complete width or half width of the stack of objects 2.

The pulling cable 18 made of elastic material connects the individual roller carriers 17 to each other, i.e. it runs through the individual roller carriers 17 of a roller wheel 7, along the perimeter of the device. For this purpose the pulling cable is e.g. hooked into a respective hook 24 of the roller carriers 17. Hereby, it may slip in hook 24 in relation to roller carrier 17, or it may be fixed. The pulling cable 18 hereby draws the roller carriers 17 and therewith the rollers 9 inwards in the direction of the position in which the longitudinal axes 10 are in perpendicular to the plane of the roller wheel 7. This position is defined by a stop 16 (FIG. 4) on the coupling 8, where the respective roller carrier 17 is stopped.

In the release region 13, the rollers 9 are pressed outwards and pivoted by the control runner or cam 15 against the spring load of the pulling cable 18 (FIGS. 4 and 5).

In FIGS. 3 and 4 a groove 23 is visible, which in each case is arranged at the rear end of the rollers 9 in the region of the coupling 8. Over these grooves, in a region of the orbit 11 of the rolling-off body 20, which is visible in FIG. 2, e.g. a further elastic cable is tensed. Thus the rollers 9 roll on the rolling-off body 20 and are made to rotate. This moving of the rollers 9 has the consequence that the rollers, when rolling need not be made, rotate by the objects 2.

FIG. 3 shows a spring 19 in broken lines as an alternative to the pulling cable 18. In a corresponding embodiment of the invention each roller or each roller carrier 17 thus comprises this kind of spring 19, which draws the roller carrier 17 towards the stop 16.

REFERENCE NUMERALS

| | |
|---|---|
| 1 | stacking space |
| 2 | flat objects |
| 3 | carrier wheel |
| 4 | suction device |
| 5 | gripper |
| 6 | arrangement for onward transportation |
| 7 | roller wheel |
| 8 | coupling |
| 9 | rollers |
| 10 | longitudinal axis |
| 11 | orbit |
| 12 | support region |
| 13 | release region |
| 14 | rotation axis |
| 15 | control runner |
| 16 | stop |
| 17 | roller carrier |
| 18 | pulling cable |
| 19 | springs |
| 20 | rolling-off body |
| 21 | interspace |
| 22 | supporting belt, rail |
| 23 | groove |
| 24 | hook |
| 25 | holding body |
| 26 | slot |
| 27 | casing |

The invention claimed is:

1. Device for separation of individual flat, bendable objects from the underside of a stack of such objects and for transporting the separated objects away, which device comprises:

a stacking space with supporting arrangement supporting the stack from beneath, circulating separation and transportation devices for separation of the objects from the underside of the stack, and an arrangement for onward transportation of the separated objects, wherein the supporting arrangement is a roll bed conveyor comprising a plurality of circulating rollers, wherein the rollers are respectively rotatable around their longitudinal axis and are moved along a circuit and hereby moved through under the stack in a supporting region in a manner aligned to the separation and transportation devices, wherein the rollers are coupled by means of a respective coupling to at least one roller wheel and that by means of this coupling the longitudinal axes of the rollers are respectively pivotable in relation to the roller wheel and the rollers are pivoted by means of a control element in a release region of the orbit and thereby create an opening through which the arrangement for onward transportation is routed wherein the control element is at least one fixed control cam on which the rollers roll and thus are pivoted, the control cam being arranged on the inside of the orbit and thus presses open the rollers and the roll bed conveyor from the inside.

2. Device according to claim 1, wherein a pivot axis of the rollers respectively runs through the couplings of the rollers on the roller wheel in a direction substantially tangential in relation to the roller wheel.

3. Device according to claim 1, wherein the longitudinal axes of the rollers in the supporting region run substantially in perpendicular to the plane of the at least one roller wheel.

4. Device according to claim 1, wherein a roller wheel supports the plurality of rollers.

5. Device according to claim 1, wherein two rollers with two sets of rollers arranged symmetrically to one another are provided.

6. Device according to claim 1, wherein the at least one roller wheel and a carrier wheel comprise parallel rotation axes.

7. Device according to claim 6, wherein the carrier wheel and the at least one roller wheel are driven to rotate at the same angle speed.

8. Device for separation of individual flat, bendable objects from the underside of a stack of such objects and for transporting the separated objects away, which device comprises:

a stacking space with supporting arrangement supporting the stack from beneath, circulating separation and transportation devices for separation of the objects from the underside of the stack and an arrangement for onward transportation of the separated objects, wherein the supporting arrangement is a roll bed conveyor comprising a plurality of circulating rollers, wherein the rollers are respectively rotatable around their longitudinal axis and are moved along a circuit and hereby moved through under the stack in a supporting region in a manner aligned to the separation and transportation devices, wherein the rollers are coupled by means of a respective coupling to at least one roller wheel and that by means of this coupling the longitudinal axes of the rollers are respectively pivotable in relation to the roller wheel and the rollers are pivoted by means of a control element in a release region of the orbit and thereby create an opening through which the arrangement for onward transportation is routed, and wherein the rotation movement of the longitudinal axes is limited in one direction by a mechanical stop, which defines a stopping position, in which the longitudinal axis substantially runs in perpendicular to the plane of the roller wheel.

9. Device for separation of individual flat, bendable objects from the underside of a stack of such objects and for transporting the separated objects away, which device comprises:

a stacking space with supporting arrangement supporting the stack from beneath, circulating separation and transportation devices for separation of the objects from the underside of the stack and an arrangement for onward transportation of the separated objects, wherein the supporting arrangement is a roll bed conveyor comprising a plurality of circulating rollers, wherein the rollers are respectively rotatable around their longitudinal axis and are moved along a circuit and hereby moved through under the stack in a supporting region in a manner aligned to the separation and transportation devices, wherein the rollers are coupled by means of a respective coupling to at least one roller wheel and that by means of this coupling the longitudinal axes of the rollers are respectively pivotable in relation to the roller wheel and the rollers are pivoted by means of a control element in a release region of the orbit and thereby create an opening through which the arrangement for onward transportation is routed, and wherein the rollers each are mounted in a roller carrier in a manner rotatable around their longitudinal axes, and the roller carrier is mounted to the roller wheel in a manner pivotable around a pivot axis, and a pre-tensing device is provided, which draws the roller carriers and with them their rollers in the direction of the stopping position of the pivoting movement.

10. Device according to claim 9, wherein the pre-tensing device comprises an elastic pulling cable, which connects the roller carriers of the individual rollers of a roller wheel to each other and thus draws all the roller carriers and with them their rollers in the direction of the stop of the pivoting movement.

11. Device according to claim 9, wherein the pre-tensing device comprises a set of spring elements and a dedicated spring element is allocated to each roller, which effects a load, wherein this load draws the roller in the direction of the stop.

12. Device for separation of individual flat, bendable objects from the underside of a stack of such objects and for transporting the separated objects away, which device comprises:

a stacking space with supporting arrangement supporting the stack from beneath, circulating separation and transportation devices for separation of the objects from the underside of the stack and an arrangement for onward transportation of the separated objects, wherein the supporting arrangement is a roll bed conveyor comprising a plurality of circulating rollers, wherein the rollers are respectively rotatable around their longitudinal axis and are moved along a circuit and hereby moved through under the stack in a supporting region in a manner aligned to the separation and transportation devices, wherein the rollers are coupled by means of a respective coupling to at least one roller wheel and that by means of this coupling the longitudinal axes of the rollers are respectively pivotable in relation to the roller wheel and the rollers are pivoted by means of a control element in a release region of the orbit and thereby create an opening through which the arrangement for onward transportation is routed, and wherein the rollers are rotatable and the rollers are rotated around their longitudinal axis in at least one section of the orbit, at least in the supporting region by means of rolling on a rolling-off body, which rotation corresponds to a rolling movement of the rollers around their longitudinal axis on the bottommost object of the stack.

13. Device for separation of individual flat, bendable objects from the underside of a stack of such objects and for transporting the separated objects away, which device comprises:

a stacking space with supporting arrangement supporting the stack from beneath, circulating separation and transportation devices for separation of the objects from the underside of the stack and an arrangement for onward transportation of the separated objects, wherein the supporting arrangement is a roll bed conveyor comprising a plurality of circulating rollers, wherein the rollers are respectively rotatable around their longitudinal axis and are moved along a circuit and hereby moved through under the stack in a supporting region in a manner aligned to the separation and transportation devices, wherein the rollers are coupled by means of a respective coupling to at least one roller wheel and that by means of this coupling the longitudinal axes of the rollers are respectively pivotable in relation to the roller wheel and the rollers are pivoted by means of a control element in a release region of the orbit and thereby create an opening through which the arrangement for onward transportation is routed, wherein the rollers are rotatable and the rollers are rotatable in at least one section of the orbit, at least in the supporting region by means of rolling on a rolling-off body, which rotation corresponds to a rolling movement of the rollers on the bottommost object of the stack, and wherein the rolling-off body is a cable tensed around a sector of the orbit.

* * * * *